US006270338B1

(12) United States Patent
Eroglu et al.

(10) Patent No.: US 6,270,338 B1
(45) Date of Patent: Aug. 7, 2001

(54) METHOD FOR OPERATING A PREMIX BURNER

(75) Inventors: Adnan Eroglu, Untersiggenthal; Jaan Hellat, Baden-Rütihof; Jakob Keller, Dottikon, all of (CH); Robin McMillan, Bardney (GB); Roger Suter, Zürich (CH)

(73) Assignee: Asea Brown Boveri AG, Baden (CH)

( * ) Notice: Subject to any disclaimer, the term of this patent is extended or adjusted under 35 U.S.C. 154(b) by 0 days.

(21) Appl. No.: 09/179,460

(22) Filed: Oct. 27, 1998

(30) Foreign Application Priority Data

Oct. 27, 1997 (EP) ..... 97810800

(51) Int. Cl.[7] ..... F23C 5/00

(52) U.S. Cl. ..... 431/8; 431/173; 431/284; 431/354; 60/737; 60/748; 239/424; 239/405

(58) Field of Search ..... 431/8, 2, 173, 431/284, 354, 1, 9, 353; 239/8, 5, 424, 423, 416, 416.5, 601, 405; 110/262; 60/737, 738, 748

(56) References Cited

U.S. PATENT DOCUMENTS

| | | | | |
|---|---|---|---|---|
| 3,088,854 | * | 5/1963 | Spies, Jr. | 239/8 |
| 4,164,540 | | 8/1979 | Slagel et al. . | |
| 4,171,091 | * | 10/1979 | Van Hardeveld et al. | 239/8 |
| 4,389,848 | | 6/1983 | Markowski et al. . | |
| 4,850,195 | | 7/1989 | Ohkubo et al. . | |
| 4,932,861 | * | 6/1990 | Keller et al. | 431/8 |
| 5,120,582 | * | 6/1992 | Browning | 239/8 |
| 5,193,995 | * | 3/1993 | Keller et al. | 431/8 |
| 5,256,058 | | 10/1993 | Slavejkov et al. | 431/8 |
| 5,269,495 | | 12/1993 | Dobbeling . | |
| 5,449,286 | * | 9/1995 | Snyder et al. | 431/8 |
| 5,567,141 | * | 10/1996 | Joshi et al. | 431/8 |
| 5,584,684 | * | 12/1996 | Dobbeling et al. | 431/8 |
| 5,617,997 | * | 4/1997 | Kobayashi et al. | 239/8 |

FOREIGN PATENT DOCUMENTS

| | | |
|---|---|---|
| 1966995 | 12/1975 | (DE) . |
| 0687858A1 | 12/1995 | (EP) . |
| 0794383A2 | 9/1997 | (EP) . |

OTHER PUBLICATIONS

"Atomization and Sprays", Lefebvre, 1989, pp. 105–107, 155–161, 238–241.

* cited by examiner

*Primary Examiner*—Ira S. Lazarus
*Assistant Examiner*—Josiah C. Cocks
(74) *Attorney, Agent, or Firm*—Burns, Doane, Swecker & Mathis, L.L.P.

(57) ABSTRACT

The object of the invention is to provide a method for operating a premix burner which has improved operational reliability and functioning during certain types of operation. In addition, it is intended to specify a corresponding premix burner for carrying out the method.

According to the invention, this is achieved by the fact that at least one liquid fuel (2) is injected into the inner chamber (9) of the premix burner (4) in a plain jet (26, 26') with an injection angle α of less than 10°. For this purpose, the liquid-fuel nozzle (17) has a simple injection opening (19) with a guide length (1) and with a diameter (d).

9 Claims, 3 Drawing Sheets

METHOD FOR OPERATING A PREMIX BURNER

BACKGROUND OF THE INVENTION

1. Field of the Invention

The invention relates to a method for operating a premix burner and to a corresponding premix burner for carrying out the method.

2. Discussion of Background

Combustion chambers with premix burners which are designed as so-called double-cone burners and in which the fuel is supplied from the outside by plug-in fuel lances have long proven suitable for stationary gas turbines in power plants. The lance is generally configured as a two-fuel lance, i.e. it is possible, as desired, to supply gaseous fuel, e.g. pilot gas, and/or liquid fuel, for example an oil/water mixture. To this end, a liquid-fuel pipe, an atomizer pipe and a pilot-gas pipe are arranged concentrically in the lance. The pipes each form a duct for the liquid fuel, the atomizer air and the pilot gas, which ducts, at the lance head, end in a central fuel nozzle. The head of the fuel lance projects into a corresponding inner pipe of the double-cone burner, so that the fuel emerging passes centrally into the burner inner chamber which adjoins the inner pipe (cf. DE 43 06 956 A1).

EP 0,321,809 B1 has also disclosed a double-cone burner which is provided for use in a combustion chamber which is connected to a gas turbine. This burner comprises two hollow part bodies which complement one another to form the double-cone burner and are arranged radially offset with respect to one another. It has a hollow-cone-shaped inner chamber which increases in size in the direction of flow and has tangential air-inlet slots. The fuel is supplied to the double-cone burner from the outside via the fuel lance which opens out into the central liquid-fuel nozzle. The latter forms a hollow-cone-shaped fuel spray, consisting of liquid fuel and air, in the burner inner chamber, in which spray most of the fuel droplets are concentrated at the outer end of the conical spray pattern.

Owing to the large injection angle of approx. 30° and the absence of an axial impulse in the center, these sprays are highly susceptible to centrifugal forces which are generated by the turbulent flow in the interior of the burner. As a result, the fuel droplets are carried relatively quickly outward by centrifugal forces, resulting, under certain operating conditions, in a not insignificant quantity of the liquid fuel striking the inner walls of the burner.

To atomize liquid fuels, inter alia so-called plain-jet atomizers are also used, which atomizers produce a conical plain jet of uniformly distributed fuel droplets. Such a solution is known from the textbook "Atomization and sprays", by A. Lefebvre, West Lafayette, Indiana 1989, pp. 106/107, 238–241. In the case of this atomizer nozzle, the liquid fuel is ejected at high pressure from an antechamber through a small, circular injection opening of a defined guide length. As a result, the plain-jet atomizer produces a fuel jet with an injection angle of approximately 5° to 15°.

However, owing to this small injection angle and the fact that the associated atomization only takes place further downstream, such plain-jet atomizers are not used in combustion chambers of gas turbine installations which are fitted with premix burners, since they require rapid atomization of the liquid fuel. In addition, the plain-jet atomizer described is not particularly suitable for numerous combustion applications, since it has a tendency to concentrate the fuel drops in a small area directly downstream of the nozzle.

Particularly under the unfavorable conditions of a low air/fuel ratio and at a low air speed, it is not possible to achieve a sufficient level of atomization.

SUMMARY OF THE INVENTION

Accordingly, one object of the invention is to provide a novel method for operating a premix burner which has improved operational reliability and functioning during certain types of operation. In addition, it is intended to specify a corresponding premix burner for carrying out the method.

According to the invention, this is achieved by the fact that, in a method for operating a premix burner which is designed in accordance with the preamble of claim 1, at least one liquid fuel is injected into the inner chamber of the premix burner in a plain jet and with an injection angle $\alpha$ of less than 10°.

For this purpose, the liquid-fuel nozzle is provided with a simple injection opening which has a guide length l and a diameter d. Owing to the influence of the opening, the liquid fuel injected through the injection opening axially into the inner chamber of the premix burner forms a plain jet, the injection angle of which is less than 10° and is therefore relatively small. The fuel jet and the combustion-air flow interact in the interior of the premix burner. Primarily as a result of the shear forces between the fuel jet and the turbulent combustion air, successful atomization is achieved in the downstream region of the premix burner, as a result of which atomization fine droplets which are suitable for combustion are produced. Owing to the small injection angle and the concentration of the axial impulse of the injected fuel in the burner axis, the influence of the angular flow on the fuel droplets is significantly reduced. As a result of the centrifugal force, the droplets are carried away from the center and for the most part mixed with the combustion air. In addition, the fuel droplets are evaporated before they reach the burner walls. In this way, it is possible for the plain jet to penetrate a substantial distance through the premix burner without the fuel droplets wetting the burner walls. Despite a considerably worse atomization quality than in conventional liquid-fuel nozzles, sufficient atomization does take place, as evidenced by the fact that there is no significant rise in the emission of pollutants.

The liquid-fuel nozzle used is particularly simple, robust and reliable, which, not unimportantly, also contributes to reducing costs. Its most important parameters are the diameter d, the guide length l and the shape of the injection opening. The degree of turbulence in the flow of fuel, which is defined primarily by the conditions upstream of the injection opening and by the abovementioned axial guide length, is also a decisive factor for the atomization.

Particularly advantageously, the injection opening has a guide length to diameter ratio of $4 \leqq l/d \leqq 6$. Test results given in the textbook "Atomization and sprays", which has already been mentioned above, by A. Lefebvre, West Lafayette, Indiana 1989, pp. 155–161, in particular in FIG. 5.4., show the influence of the guide length to diameter ratio of the injection opening on the injection coefficient, i.e. on the ratio of the current flow rate to the theoretical flow rate through the injection opening. In that study, l/d quotients of up to 10 were examined and it was established that the greatest injection coefficient is achieved at an l/d quotient of approx. 2. In contrast to this teaching, the premix burner according to the invention has been equipped with a liquid-fuel nozzle, the injection opening of which has a guide length to diameter ratio of $4 \leqq l/d \leqq 6$ and consequently has an injection coefficient which lies significantly below the maximum.

Nevertheless, the use of a liquid-fuel nozzle designed in this way has made it possible, in a premix burner, to achieve a compact liquid-fuel spray with the desired injection angle and the necessary impulse.

Owing to this compact liquid-fuel spray, such an atomizer nozzle, or a correspondingly equipped premix burner, still does not have a completely prepared fuel mixture present at the burner head. For this reason, a pulse-free operation is achieved over a broad load range and also with a different quantity of water. In addition, the compact liquid-fuel spray does not strike the burner walls, so that overheating of the premix burner and the combustion chamber can also be prevented, as can coking inside the premix burner. A further advantage, which can be attributed to the liquid-fuel spray being situated exclusively inside the combustion-air flow, is the successful ignition and the ability to operate under partial loads without an additional injection stage. As a result, both the fuel lance and the running design of the combustion chamber as a whole are more simple and less expensive. Finally, it is also possible to retrofit existing premix burners at minimal cost.

Particularly advantageously, a shielding-air flow with a low mass is introduced into the inner chamber of the premix burner outside and concentrically with respect to the liquid fuel. For this purpose, the fuel lance comprises a central liquid-fuel pipe which is coaxially surrounded by an air pipe. Since in this method or through the corresponding device the liquid fuel jet is surrounded by an air flow, the liquid-fuel spray remains in the center of the burner inner chamber even at a low mass flow rate. As a result, the stability of the liquid fuel is improved in particular at low liquid flow rates, i.e. during ignition and under partial load of the gas turbine, with both an improved ignition performance and a higher partial-load combustion performance being achieved. By contrast, at high liquid flow rates the liquid flow is dominant. Moreover, the injection opening and the area of the burner head are protected from fuel deposits and consequently from coking by the air flow.

It is particularly expedient if the shielding-air flow is injected into the inner chamber of the premix burner at a speed of from 5 to 60 m/s and with a mass of from 0.1 to 2.0% of the total air mass flow.

In contrast to the solutions which are known in the prior art, this shielding-air flow is not used to atomize the liquid fuel, which would require approximately 5 to 10% of the total air mass flow. Rather, this small volume of axially injected air is used to control the aerodynamics in the area in the vicinity of the injection opening, i.e. to improve the flow conditions in the premix burner. On the one hand, the air prevents the suction, which is otherwise caused by the jump in cross section downstream of the injection opening, of the liquid jet onto the inner wall of the premix burner, and, on the other hand, the air prevents an excessive local angular momentum. In addition, the air flow increases the axial penetration of the liquid plain jet emerging from the liquid-fuel nozzle. The jet is therefore more stable with respect to the burner turbulence or its centrifugal forces, further reducing the tendency of the fuel droplets to strike the inner wall of the premix burner. If pilot gas is used, its supply slots/openings can also be protected from coking by means of the shielding-air flow.

In a further configuration of the invention, the plain jet, which widens out in the direction of flow in the inner chamber of the premix burner, is surrounded by a rotating combustion-air flow which flows tangentially into the burner. The combustion mixture which is formed is ignited in the region of the burner mouth, the flame being stabilized in this region by a back-flow zone. For this purpose, the premix burner comprises at least two hollow part-cone bodies, which are arranged radially offset with respect to one another, having a hollow-cone-shaped inner chamber which increases in size in the direction of flow.

The burner has tangential air-inlet slots and the liquid-fuel nozzle is connected to a fuel lance which serves to supply the fuel.

In particular, this method provides a shape of liquid spray with a small injection angle which interacts optimally with the small opening angle of the premix burner. As a result, ideal conditions for the combustion of liquid fuel are created by means of a premix burner designed in this way.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, which illustrate two exemplary embodiments of the invention with reference to a premix burner which is fitted in the combustion chamber of a gas turbine installation and has a liquid-fuel nozzle according to the invention. In the drawings.

Only those components which are essential to gain an understanding of the invention are shown. Components of the gas turbine installation which are not illustrated are, for example, the compressor and the gas turbine. The direction of flow of the working media is indicated by arrows.

DESCRIPTION OF THE PREFERRED EMBODIMENTS

Figure 1:
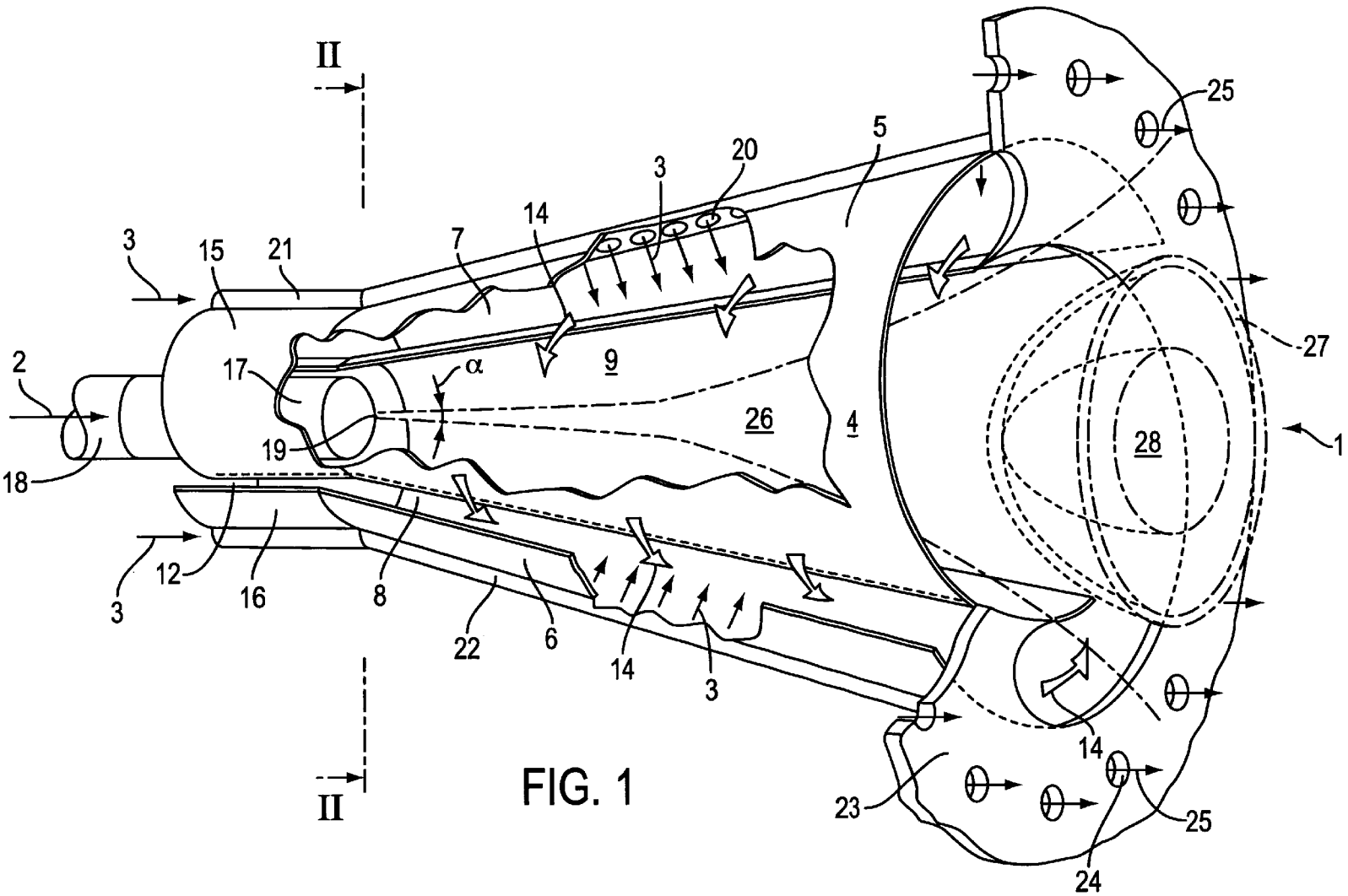
FIG. 1 shows a longitudinal section through the premix burner.
Figure 2:
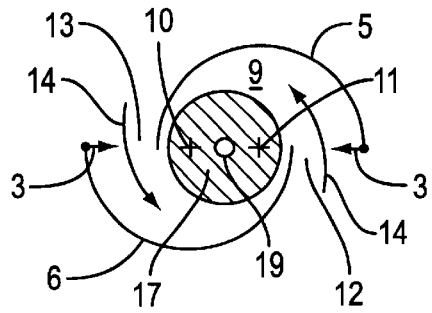
FIG. 2 shows a section through the premix burner on the line of arrows II—II in FIG. 1.
Figure 3:
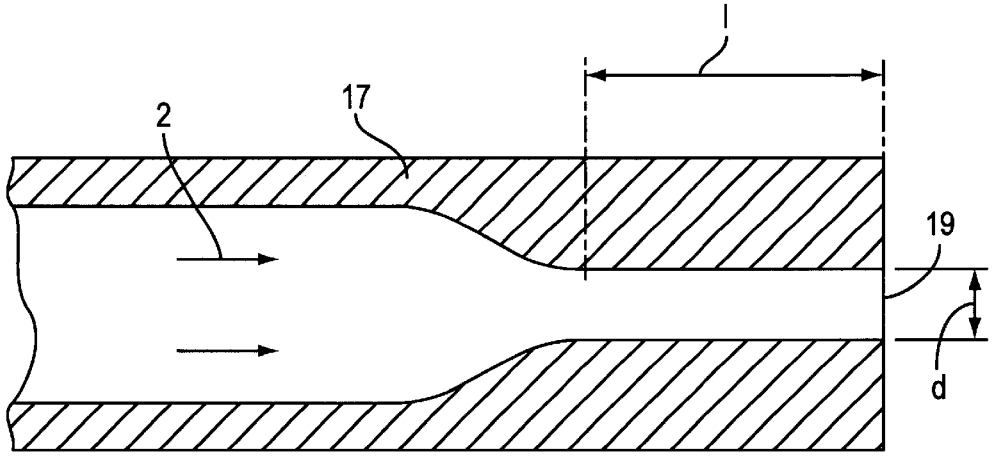
FIG. 3 shows an enlarged excerpt from FIG. 1, in the region of the liquid-fuel nozzle.

Referring now to the drawings, wherein like reference numerals designate identical or corresponding parts throughout the several views, the gas turbine installation (not shown) comprises a compressor, a gas turbine and a combustion chamber 1. A plurality of premix burners 4, which are suitable for operation with liquid fuel 2 and with gaseous fuel 3 and are designed as double-cone burners, are arranged in the combustion chamber 1. The double-cone burners 4 in each case comprise two half, hollow part-cone bodies 5, 6, each with an inner wall 7, 8. The two inner walls 7, 8 enclose a hollow-cone-shaped inner chamber 9 which increases in size in the direction of flow (FIG. 1). The part-cone bodies 5, 6 each have a center axis 10, 11 which is arranged offset with respect to the other center axis. As a result, they lie radially offset with respect to one another, one above the other, and form a tangential air-inlet slot 12, 13 on both sides of the double-cone burner 4, through which slot combustion air 14 flows into the inner chamber 9 (FIG. 2). The two part-cone bodies 5, 6 each have a cylindrical initial part 15, 16. The initial parts 15, 16 are, like the part-cone bodies 5, 6, arranged offset with respect to one another. An end piece, which is designed as a central liquid-fuel nozzle 17, of a fuel lance 18, which serves to supply fuel to the double-cone burner 4, is arranged so as to project into the initial parts 15, 16 and into the inner chamber 9 (FIG. 1). The liquid-fuel nozzle 17 has a simple, circular injection opening 19 (FIG. 2). This injection opening 19 has a diameter d and a guide length l, the quotient of guide length l and diameter d being equal to 4 (FIG. 3).

Naturally, depending on the specific conditions of use of the double-cone burner 4, the injection opening 19 may also have another suitable shape and said quotient of guide length and diameter may amount to up to 6. Of course, the double-cone burner 4 may be of purely conical shape, i.e. without the cylindrical initial parts 15, 16 (not shown).

The two part-cone bodies each have a fuel line 21, 22 which is provided with openings and is arranged at the end of the tangential air-inlet slots 12, 13. The gaseous fuel 3 is supplied through the fuel lines 21, 22 and is introduced into the tangential air-inlet slots 12, 13 via the openings 20. In that area, the gaseous fuel 3 is mixed with the combustion air 14 which flows in from the outside. On the combustion chamber side 1, the double-cone burner 4 has a collar-shaped end plate 23 with a number of bores 24, which plate serves to anchor the part-cone bodies 5, 6 (FIG. 1). If necessary, cooling air 25 can be supplied to the combustion chamber 1 through these bores 24.

The double-cone burner 4 is supplied with fuel oil which is used as liquid fuel 2 via the fuel lance 18. The fuel oil 2 is injected into the inner chamber 9 through the central injection opening 19 in the liquid-fuel nozzle 17 with an injection angle $\alpha$ of less than 10°. Owing to this narrow injection angle, a plain jet 26, which is initially very compact, only opens out downstream and in which the fuel droplets are distributed uniformly over the entire cross section, is formed in the inner chamber 9 of the double-cone burner 4. In contrast to the hollow-cone-shaped fuel spray which is used in double-cone burners of the prior art, such a plain jet 26, however, has sufficient axial impulses in its center for the fuel droplets not to be carried onto the inner walls 7, 8 of the part-cone bodies 5, 6. In addition, this effect can be amplified further by a relatively high injection speed of the fuel oil 2 of from 20 to 60 m/s.

The plain jet 26 widens out uniformly in the direction of flow in the inner chamber 9 of the double-cone burner 4 and thus ultimately assumes the form of a cone. The plain jet 26 is surrounded by the rotating combustion air 14 which flows in through the tangential air-inlet slots 12, 13. The fuel mixture formed is ignited in the region of the burner mouth, producing a flame front 27 which for its part is stabilized in the region of the burner mouth by a back-flow zone 28.

Since the fuel oil 2 is atomized primarily by the combustion air 14, it is not the injection speed of the plain jet 26, but rather the combustion air 14 which is decisive for the quality of atomization and hence for the subsequent combustion. In this way, the necessary flexibility is achieved to operate the double-cone burner 4 or the combustion chamber 1 under all load conditions, i.e. from ignition all the way through to full load, with the same injection concept.

In addition, of course, it is also possible, using a fuel pump which is not shown and is connected to the fuel lance 18, to control the impulse of the plain jet 26 in such a way that the penetration depth of the fuel drops which is required depending on the premix burner 4 used and the current load state of the combustion chamber 1 is achieved.

Figure 4:
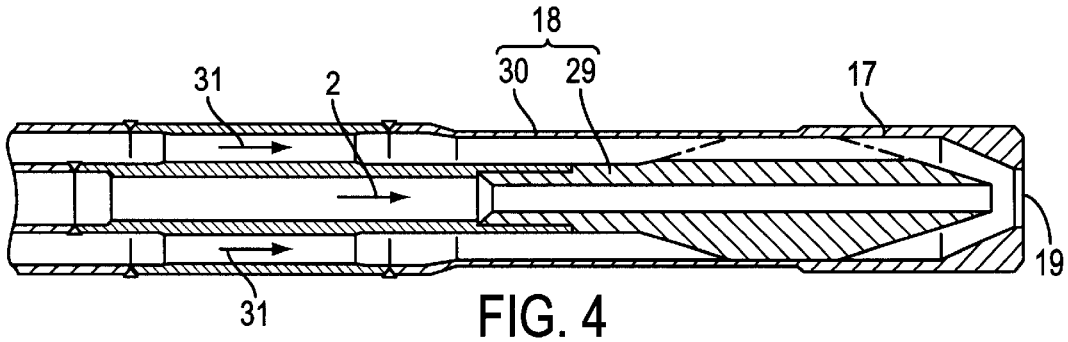
FIG. 4 shows a second exemplary embodiment of the fuel lance which is equipped with a liquid-fuel nozzle.
Figure 5:
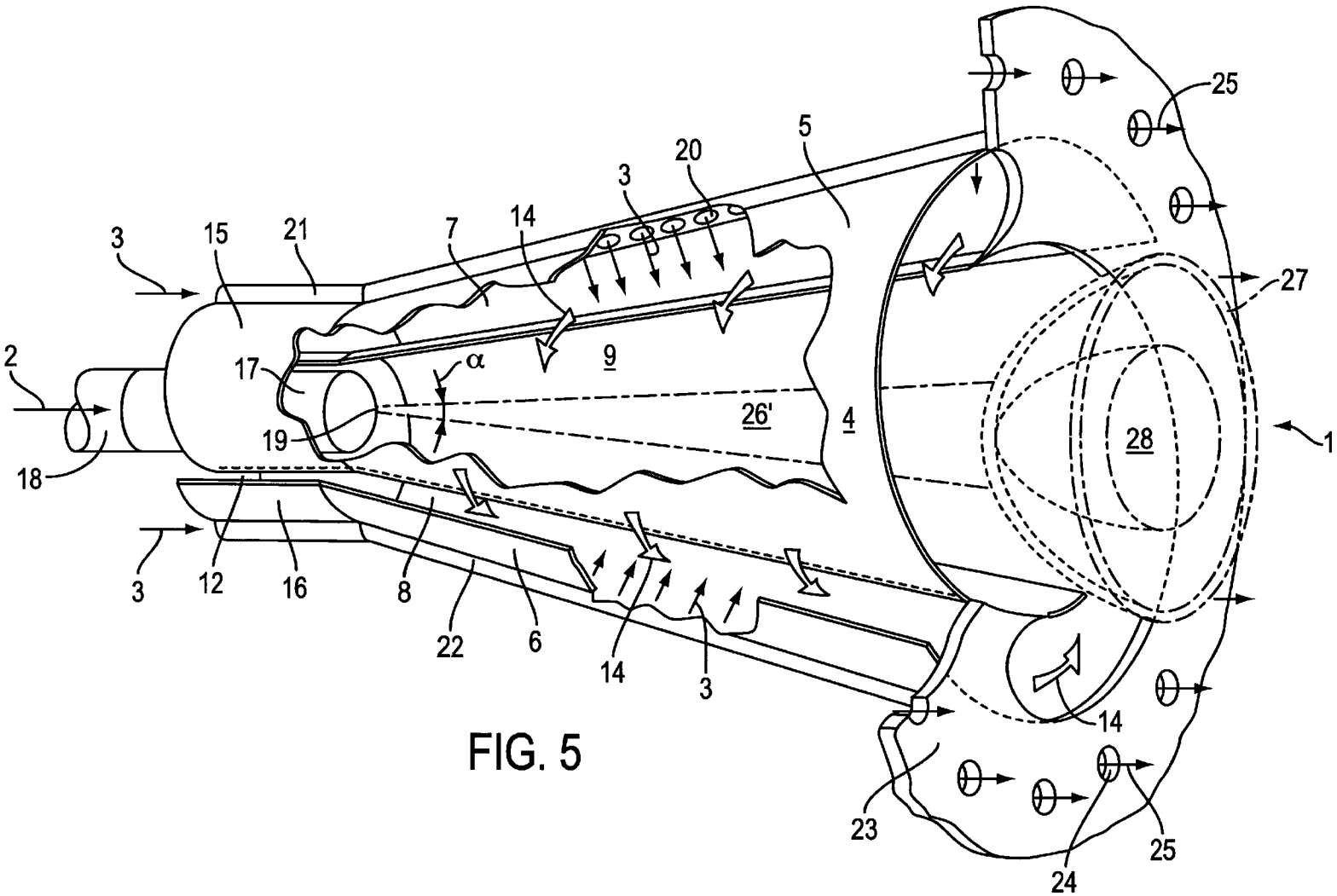
FIG. 5 shows a longitudinal section through the premix burner which is fitted with the liquid-fuel nozzle designed in accordance with FIG. 4.

In a second exemplary embodiment, with a double-cone burner 4 of similar design, the fuel lance 18 comprises a central liquid-fuel pipe 29 which is coaxially surrounded by an air pipe 30 (FIG. 4). Therefore, during operation of the double-cone burner 4, a shielding-air flow 31 is introduced into the inner chamber 9 of the double-cone burner 4 at the same time as the fuel oil 2 is injected, but radially outside and concentrically with respect to the fuel oil 2. This shielding-air flow 31 is injected at a speed of approx. 30 m/s and constituting a mass of from 0.1 to 2.0% of the total air mass flow of the double-cone burner 4. The result is an even more compact plain jet 26' which opens up only at the end of the burner (FIG. 5). At the same time, the shielding-air flow 31, which passes through the air pipe 30 into the inner chamber 9 of the double-cone burner 4, cools and protects the liquid-fuel pipe 29. All the further sequences are essentially analogous to the first exemplary embodiment.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A premix burner comprising:

at least two hollow part-cone bodies arranged radially offset with respect to one another, said hollow part-cone bodies together defining a hollow-cone-shaped inner chamber which increases in size in the direction of flow;

tangential air-inlet slots;

a liquid-fuel nozzle which opens centrally into the inner chamber;

a fuel lance in fluid communication with the liquid-fuel nozzle for supplying fuel;

wherein the liquid-fuel nozzle has a simple injection opening with a guide length (l) and with a diameter (d), the injection opening having a guide length (l) to diameter (d) ratio of $4 \leqq l/d \leqq 6$.

2. The premix burner as claimed in claim 1, wherein the fuel lance comprises a central liquid-fuel pipe and an air pipe, the air pipe and the central liquid-fuel pipe being coaxial and said air pipe surrounding said central liquid-fuel pipe.

3. The premix burner as claimed in claim 1, wherein the premix burner is configured and arranged to lack inlet openings for an auxiliary medium which atomizes said liquid fuel jet in the inner chamber.

4. A method for operating a premix burner having a liquid-fuel nozzle which opens centrally into an inner chamber of the premix burner the method comprising:

injecting at least one liquid fuel into the inner chamber in a compact, non-auxiliary-medium atomized liquid fuel plain jet with an injection angle $\alpha$ of less than 10°;

wherein said injecting step is performed in a premix burner comprising:

at least two hollow part-cone bodies arranged radially offset with respect to one another, said hollow part-cone bodies together defining a hollow-cone-shaped inner chamber which increases in size in the direction of flow;

tangential air-inlet slots;

a liquid-fuel nozzle which opens centrally into the inner chamber;

a fuel lance in fluid communication with the liquid-fuel nozzle for supplying fuel;

wherein the liquid-fuel nozzle has an injection opening with a guide length (l) and with a diameter (d), the injection opening having a guide length (l) to diameter (d) ratio of $4 \leqq l/d \leqq 6$.

5. The method as claimed in claim 4, wherein the step of injecting at least one liquid fuel into the inner chamber comprises injecting in the absence of an auxiliary medium which atomizes the at least one liquid fuel in the inner chamber.

6. The method as claimed in claim 4, further comprising introducing a shielding-air flow into the inner chamber radially outside and concentrically with respect to the at least one liquid fuel.

7. The method as claimed in claim 6, wherein the premix burner has a total air mass flow flowing therethrough, and the shielding-air flow is between 0.1% and 2.0% of the premix burner total air mass flow.

8. The method as claimed in claim 7, wherein the step of introducing a shielding-air flow comprises introducing shielding-air into inner chamber at a speed of from 5 to 60 m/s.

9. The method as claimed in claim 4, wherein the premix burner also includes a burner mouth, wherein the step of injecting a plain jet comprises injecting a plain jet along a direction of flow, the plain jet widening out in the direction of flow in the inner chamber, and further comprising:

flowing a rotating combustion-air flow which flows tangentially into the premix burner around the plain jet;

forming a mixture of fuel and air; and igniting the mixture proximate the burner mouth to form a flame front, wherein the flame front is stabilized by a back-flow zone.

* * * * *